US008578665B2

(12) United States Patent
Reyes et al.

(10) Patent No.: US 8,578,665 B2
(45) Date of Patent: Nov. 12, 2013

(54) MODULAR GUY ANCHOR

(71) Applicant: ATC IP LLC, Boston, MA (US)

(72) Inventors: Jaime Reyes, Grapevine, TX (US); Hanming You, Carrollton, TX (US); Hernando Artista, Grand Prairie, TX (US)

(73) Assignee: ATC IP LLC, Boston, MA (US)

( * ) Notice: Subject to any disclaimer, the term of this patent is extended or adjusted under 35 U.S.C. 154(b) by 0 days.

(21) Appl. No.: 13/758,391

(22) Filed: Feb. 4, 2013

(65) Prior Publication Data

US 2013/0145701 A1 Jun. 13, 2013

Related U.S. Application Data

(63) Continuation of application No. 12/899,878, filed on Oct. 7, 2010, now Pat. No. 8,375,651.

(60) Provisional application No. 61/363,646, filed on Jul. 13, 2010.

(51) Int. Cl.
*E04H 12/20* (2006.01)

(52) U.S. Cl.
USPC ..... 52/151; 52/148

(58) Field of Classification Search
USPC ..... 52/146, 147, 148, 149, 150, 151, 152
See application file for complete search history.

(56) References Cited

U.S. PATENT DOCUMENTS

| | | | | |
|---|---|---|---|---|
| 957,823 | A * | 5/1910 | Viles | 403/46 |
| 3,119,471 | A * | 1/1964 | Turner | 52/148 |
| 3,368,319 | A * | 2/1968 | Thomas et al. | 52/637 |
| 4,124,983 | A * | 11/1978 | Weatherby | 405/259.5 |
| 4,285,993 | A | 8/1981 | Green | |
| 4,676,276 | A | 6/1987 | Fawley | |
| 4,899,500 | A | 2/1990 | Miller et al. | |
| 5,097,558 | A * | 3/1992 | Accorsi et al. | 14/73 |
| 5,098,780 | A * | 3/1992 | Nemunaitis et al. | 428/312.4 |
| 5,888,025 | A | 3/1999 | Papousek | |
| 6,311,565 | B1 * | 11/2001 | Hinz et al. | 73/801 |
| 6,908,258 | B2 | 6/2005 | Timmerman | |
| 7,097,154 | B2 * | 8/2006 | Stevens | 254/233 |
| 7,390,144 | B2 | 6/2008 | Fedrick | |
| 7,827,741 | B2 * | 11/2010 | Davies et al. | 52/151 |
| 7,913,463 | B2 * | 3/2011 | Russell | 52/127.2 |
| 2008/0193224 | A1 * | 8/2008 | Davies et al. | 405/259.1 |

OTHER PUBLICATIONS

Davies, "Guy Anchor Rod Corrosion: Probability, Self Inspection, Detection, and Prevention," www.eriinc.com, Electronics Research, Inc., 7777 Gardner Road, Chandler, Indiana 47610-9219, Jan. 16, 2009.

(Continued)

*Primary Examiner* — William Gilbert
*Assistant Examiner* — Gisele Ford
(74) *Attorney, Agent, or Firm* — BainwoodHuang

(57) ABSTRACT

A modular guy anchor includes an anchor head and an anchor shaft. The anchor head includes a tubular region for receiving the anchor shaft. The anchor shaft has one end that extends into or through the tubular region and is retained therein. The anchor shaft is preferably galvanized steel coated over at least a portion of its length with a corrosion-resistant material. The corrosion-resistant material is preferably applied over any portion of the anchor shaft that is exposed to soil during normal use. The modularity of the guy anchor facilitates stocking, shipping, and installation, while the corrosion resistance of the anchor shaft promotes longevity.

14 Claims, 4 Drawing Sheets

(56) References Cited

OTHER PUBLICATIONS

"Ultra Guy Anchor Rod," (Data Sheet), Electronic Research, Inc. Publication No. 20090321011_AEN01, 2009.

"Helical Tieback Anchors for Earth Retention," Guide to Model Specification, Chance Civil Construction, Bulletin 31-0503, Rev. Apr. 2006, A.B. Chance, a Division of Hubbell Power Systems, Inc., Centralia, Missouri.

"DYWIDAG Threadbar Reinforcing Systems," (Information Sheet) DYWIDAG Systems International USA, Inc., 320 Marmon Drive, Bolingbrook, IL 60440, downloaded Oct. 26, 2010 from http://www.dywidag-systems.com/uploads/media/DSA-USA_DYWIDAG_Threadbar_Reinforcing_Systems_us.pdf.

"Assembling Your Antenna System," Luxorion, first downloaded Jun. 28, 2010 from http://www.astrosurf.com/luxorion/qsitower-assembly.htm.

"Corrosion Protection for Tower Structures," TechNotes, PolyPhaser Corporation, Global Lighting Solutions, 10701 Airport Drive, Hayden, ID, first downloaded Jun. 28, 2010.

Parker et al., "Examining Tower Guy Wire Anchor Rods," Westinghouse Savannah River Company, Aiken, South Carolina, first downloaded Jun. 28, 2010 from http//hps.ne.uiuc.edu/numug/archive/2002/presentations/parker-anchorrods.ppt.

Snyder, "Understanding and Preventing Guyed Tower Failure Due to Anchor Shaft Corrosion," Sioux Falls Tower Specialists, Inc., AnchorGuard—Corrosion Control for Tower Anchors, Sioux Falls, South Dakota, first downloaded Jun. 28, 2010 from http://www.itrainonline.org/itrainonline/mmtk/wireless_en/11_Communication_Tower/preventing_corrosion.pdf.

"Specifications," AnchorGuard, 2224 E. 39th St. N., Sioux Falls, SD 57104-5409, downloaded Jun. 28, 2010 from http://www.anchorguard.com/Specifications.pdf.

"Tower Corrosion Protection: Lightning Protection Information," first downloaded Jun. 28, 2010 from http://www/commomni.com/polyweb/corrosionprotect.htm.

* cited by examiner

MODULAR GUY ANCHOR

CROSS-REFERENCES TO RELATED APPLICATIONS

This is a continuation application of U.S. application Ser. No. 12/899,878, filed on Oct. 7, 20120, which claims the benefit of U.S. Provisional Application No. 61/363,646, filed Jul. 13, 2010, which are incorporated herein by reference in their entireties.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO A "SEQUENCE LISTING," A TABLE, OR A COMPUTER PROGRAM LISTING APPENDIX

Not Applicable.

BACKGROUND OF THE INVENTION

1. Field of the Invention

This invention relates generally to guyed construction techniques, and, more particularly, to techniques for anchoring guyed and additionally guyed towers.

2. Description of Related Art

Towers are widely used in many industries, including television transmission, radio communication, cell phone communication, wind turbines, and power transmission, to name a few.

Some towers, known as "guyed towers" or "additionally guyed towers," rely on guy wires to maintain or assist in maintaining the towers in a vertical orientation. Generally speaking, these towers include a vertical main body, or "mast," that stands on one end atop a base, which is generally concrete. Guy wires attach to the mast along its length, extend down and away from the mast, and attach securely to the ground using anchors. Most guyed towers are triangular in cross-section, and a minimum of three guy anchors are typically provided and are spaced apart by approximately 120-degrees to provide a stable base for holding the mast vertically. Often, guyed towers require three, six, or more guy anchors with multiple guy wires originating from different vertical levels of the tower attached to each guy anchor.

The term "guyed towers" describes towers whose masts have no independent means of support. They rely entirely upon guy wires to hold them upright. By contrast, the term "additionally guyed towers" describes towers that are essentially free standing, although they require guy wires to provide reinforcement and stability.

FIG. 1 shows a conventional guy anchor 100 for an erected tower. As shown in this example, four guy wires 110 originating from the tower's mast attach to an anchor head 114. The guy wires 110 are generally composed of steel or some other high tensile strength metal. A shaft 116 extends from the anchor head 114 and into the ground 124. Typically, the anchor head 114 and shaft 116, which are also generally made of steel, are provided as a single unit, with the shaft 116 permanently welded to the head 114. The distal end of the shaft 116 is typically buried in a steel-reinforced mass of concrete 118, also known as a "dead-man." The weight of the dead-man 118 and the earth above it holds the shaft 116 securely in place, even in the presence of large forces on the tower due to wind and precipitation.

The typical guy anchor assembly 100 may also include turnbuckles 112. One turnbuckle 112 is generally provided for each guy wire 110. The role of the turnbuckles 112 is to fine-tune the tightness of each guy wire 110.

To prevent damage due to lightning strikes, the guy wires 110 are each electrically connected via a conductive cable 120 to a ground spike 122. The ground spike 122 is typically made of copper. The cable 120 and ground spike 122 form a low impedance path to ground. This arrangement is designed to conduct high current surges away from the shaft 116, thereby preventing damage to the shaft which could otherwise compromise the mechanical stability of the tower.

One drawback of the conventional guy anchor assembly 100 is that the anchor shaft 116 often corrodes over time. Over several years of use (and sometimes less time), corrosion may lead to a complete failure of the anchor shaft 116, which can result in a collapse of the tower it supports.

Guy anchor shaft corrosion typically affects the area of the shaft exposed to soil, i.e., underground but excluding the region encased within the dead-man 118. Corrosion may be galvanic or electrolytic in nature, or may be caused by other factors. In an effort to prevent corrosion, guy anchor shafts are typically galvanized.

BRIEF SUMMARY OF THE INVENTION

We have recognized that galvanizing the shaft is often insufficient. The galvanized coatings can become cracked or suffer abrasions during handling, thereby exposing the underlying, ungalvanized metal. The exposed metal is especially prone to concentrated corrosion, which may lead to premature failure of the anchor shafts.

We have also recognized that the conventional guy anchor assemblies 100 are sometimes difficult to stock, ship, and install. As indicated, the guy anchor head 114 and shaft 116 are provided as a single unit. Manufacturers make them with varying lengths (generally 4.9-6.1 m, or 16-20 ft.) to accommodate a variety of conditions, and with a variety of different size anchor heads (e.g., for accommodating different numbers of guy wires and/or different amounts of tension). Consequently, a large number of different units are generally stocked. Often, a unit will be selected when a tower project is commenced, but the length of that unit may be deemed inappropriate once all the details are known about the foundation, soil conditions, and other factors. Installers are warned not to cut anchor shafts, at the risk of impairing their function or longevity, so an anchor whose shaft is the wrong size must often be replaced before installation can resume. Such replacement entails delays and additional cost.

What is needed, therefore, is a guy anchor assembly that is resistant to corrosion and is relatively inexpensive and convenient to stock, ship, and install.

According to one embodiment hereof, a modular guy anchor includes an anchor head and an anchor shaft. The anchor head has a tubular region. The anchor shaft has one end extending into or through the tubular region of the anchor head, and the anchor shaft is retained within the tubular region.

According to another embodiment, a modular guy anchor includes an anchor head having an internally threaded, tubular region and an anchor shaft having an end that is externally threaded. The end of the anchor shaft and the tubular region are threaded together.

According to yet another embodiment, a guy anchor includes an anchor shaft, wherein the anchor shaft is galvanized and coated over at least a portion of its length with a material including a combination of Kevlar and at least one of urethane, epoxy, and latex.

According to still another embodiment, an anchor head for a modular guy anchor includes a head plate having a plurality of holes arranged substantially along a line for attaching to guy wires. The anchor head further includes a tube for receiving an anchor shaft. The tube is permanently affixed to or integral with the head plate and oriented perpendicularly to the line formed by the plurality of holes.

According to yet another embodiment, a method of installing a guy anchor for a tower includes assembling the guy anchor on-site, including fastening together an anchor head and an anchor shaft. The method further includes placing the assembled guy anchor into a hole and pouring concrete into the hole to secure the guy anchor.

According to a still further embodiment, a tower includes a tower mast, a plurality of guy anchors spaced around the tower mast, and a plurality of guy wires connecting the tower mast to the plurality of guy anchors. Each of the plurality of guy anchors includes an anchor head connected to at least one of the plurality of guy wires. Each guy anchor further includes a tubular region and an anchor shaft having an end. The end of the anchor shaft extends into or through the tubular region, and the anchor shaft is retained within the tubular region.

DETAILED DESCRIPTION OF THE INVENTION

The modular guy anchor as presented herein resists corrosion from contact with soil. It is generally more convenient and less expensive than conventional guy anchors from the standpoints of stocking, shipping, and installation.

As used throughout this document, the words "comprising," "including," and "having" are intended to set forth certain items, steps, elements, or aspects of something in an open-ended fashion. In addition, the terms "thread" and "threaded" describe any object with a helical pattern of ridges that may be screwed to another object with a complementary pattern. They include both machined threads and thread-like deformations formed using other processes. Although certain embodiments are disclosed herein, it is understood that these are provided by way of example only and that the invention is not limited to these particular embodiments.

Figure 2:
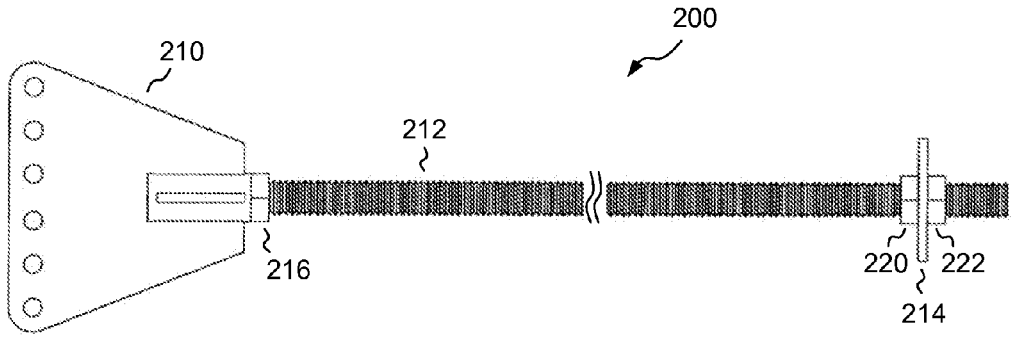
FIG. 2 is a front view of a modular guy anchor according to an illustrative embodiment of the invention.
Figure 3:
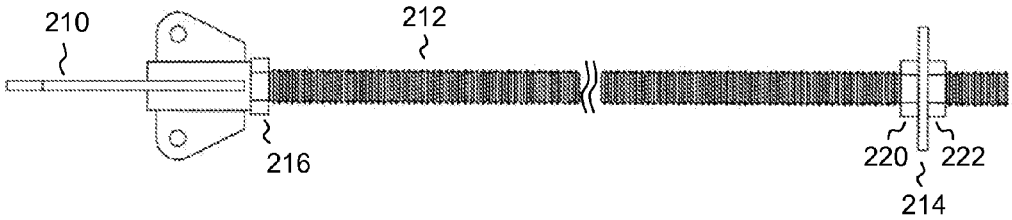
FIG. 3 is a top view of the modular guy anchor of FIG. 2.
Figure 4:
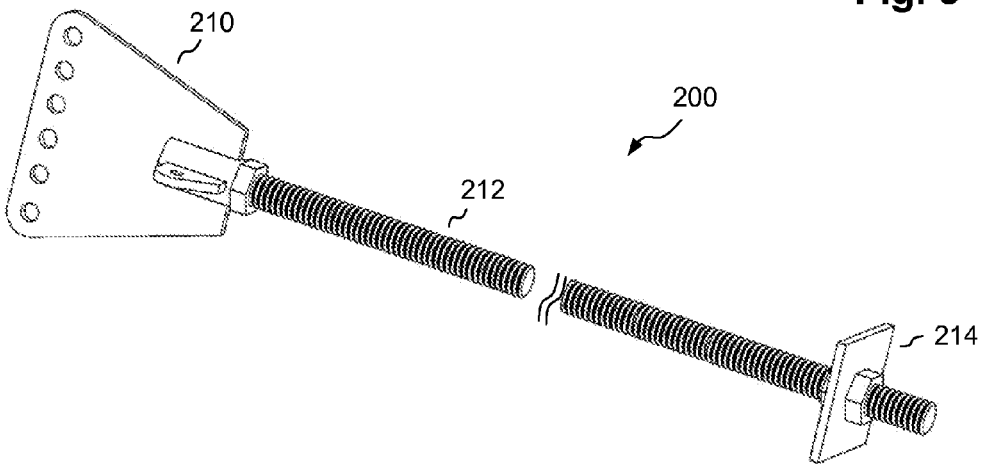
FIG. 4 is a perspective view of the modular guy anchor of FIGS. 2-3.
Figure 5:
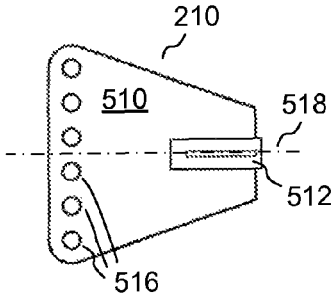
FIGS. 5-8 are different views of an anchor head used in the modular guy anchor of FIGS. 2-4.
Figure 6:
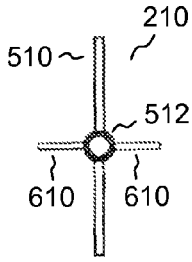
Figure 8:
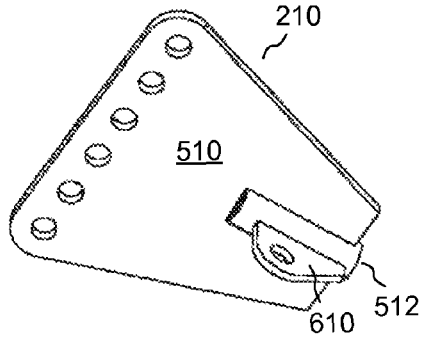
Figure 7:
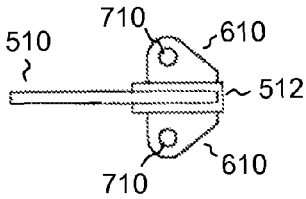

FIGS. 2-4 show a modular guy anchor 200 according to an illustrative embodiment of the invention. The guy anchor 200 includes an anchor head 210, an anchor shaft 212, and a retaining structure, such as a bearing plate 214. The anchor shaft 212 attaches to the anchor head 210 at a proximal end of the anchor shaft 212, and attaches to the bearing plate 214 at a distal end.

The anchor shaft 212 is preferably a threaded bar. At the proximal end, the anchor shaft 212 is screwed into a threaded, tubular region of the anchor head 210. Jamb nut 216 is preferably provided to secure the attachment between the shaft 212 and the anchor head 210 and to prevent rotation of the head with respect to the shaft. At the distal end, the threaded bar 212 is preferably affixed to the bearing plate 214 using nuts 220 and 222.

FIGS. 5-8 show different views of the anchor head 210. The anchor head 210 includes a head plate 510, a tubular region, or coupler, 512, and a pair of rigging plates 610. Holes 516 are provided in the head plate 510 to facilitate attachment of the guy anchor to guy wires, in a manner similar to that shown in FIG. 1. The coupler 512 is preferably internally threaded, with a thread pattern that complementarily matches that of the guy shaft 212. The coupler 512 is preferably a separate component that is positioned along a central axis 518 of the of the head plate 510 and welded to the head plate. The rigging plates 610 are preferably welded to the coupler 512. They have holes 710, which may be used to facilitate the attachment of guy wires during guy tower installation or upgrade.

Figure 9:
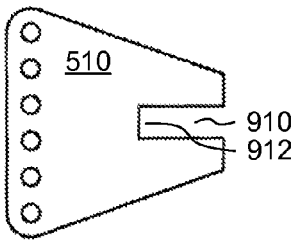
FIGS. 9-11 are different views of some of the component parts of the anchor head of FIGS. 5-8 prior to welding.
Figure 10:
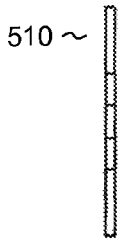
Figure 11:
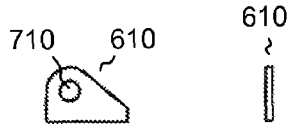

FIGS. 9-11 show some of the component parts of the guy anchor head 510. It can be seen in FIG. 9 that the head plate 510 includes a channel 910, and that the channel has an end 912. During construction, the top and bottom of the channel are preferably welded to the coupler 512 to hold the coupler securely in place.

Figure 12:
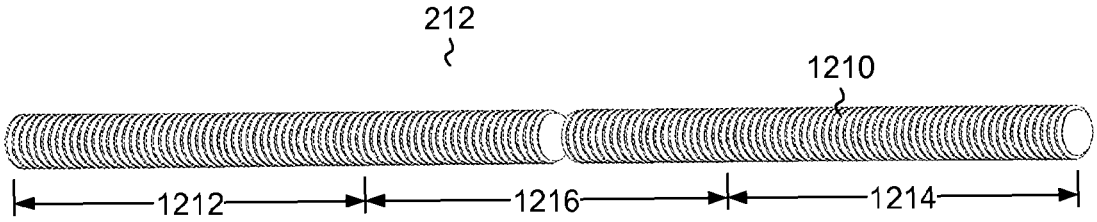
FIG. 12 is a view of a threaded bar that may be used in the modular guy anchor of FIGS. 2-4, showing locations where a corrosion-resistant coating is applied.

FIG. 12 shows a preferred embodiment of the anchor shaft 212. Here, the anchor shaft is a threaded bar. The bar is preferably galvanized over its entire length. After the bar is galvanized, it is coated with a corrosion-resistant material. Region 1212 is where the anchor head is attached, and region 1214 is where the bearing plate is attached. Region 1216 is between regions 1212 and 1214. After installation, region 1212 is above ground and region 1214 is encased in concrete (within the dead-man). Therefore, only region 1216 is exposed to soil. To reduce cost and to prevent the corrosion-resistant coating from interfering with the threaded attachments, only the region 1216 is preferably coated with the corrosion-resistant material. The coating is preferably not applied to regions 1212 and 1214.

Various corrosion-resistant materials and techniques were tried. One included greasing the portions of the anchor shaft exposed to soil and wrapping the greased anchor shaft with rubber. The method proved partially successful but inconsistent. Another included a powder coating called Plascoat PPA 571, available from Plascoat Systems, Ltd. of Surrey, UK.

The best performing material for this purpose discovered as of the time of this writing is Line-X Xtra®. Line-X Xtra is a composite coating that includes urethane and DuPont™ Kevlar® micro pulp. This material provides numerous advantages. It resists corrosion by sealing out water, salts, acids, and other materials in soil. It electrically insulates the anchor shaft from the soil, thereby inhibiting galvanic and electrolytic corrosion. It also resists abrasion and scratches, helping to preserve the integrity of the galvanized surface of the anchor shaft. The Line-X Xtra coating is preferably sprayed on. Optimal coating thickness has yet to be determined, although we have found that a coating of 0.36 mm (14 mils) provides excellent corrosion resistance. Line-X Xtra is available through dealers, which may be contacted through Advanced Protective Coatings, dba LINE-X, of Huntsville, Ala.

Figure 13:
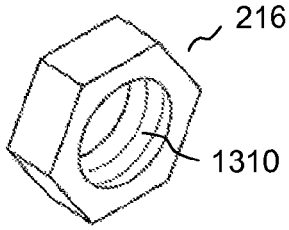
FIG. 13 is a perspective view of a nut used in the modular guy anchor of FIGS. 2-4.

FIG. 13 shows a jamb nut, which may be used for the nuts 216, 220, and 222 of the modular guy anchor 200. The jamb nuts 216, 220, and 222 have internal threads, which complementarily match the threads of the anchor shaft 212.

Figure 14:
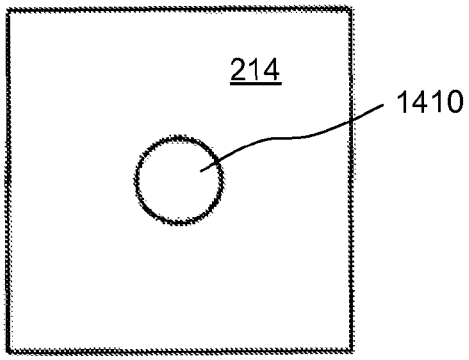
FIGS. 14-15 are front and side views of an anchor bearing plate used in the modular guy anchor of FIGS. 2-4.
Figure 15:
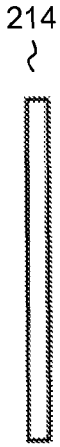

FIGS. 14 and 15 show the bearing plate 214. The bearing plate 214 is designed to be embedded within to the concrete dead-man 118 so that the load from the anchor shaft 212 can be transferred to the dead-man. Preferably, the bearing plate 214 is a square metal plate having a central clearance hole 1410 through which the anchor shaft 212 is passed during assembly. The bearing plate 214 is preferably attached to the anchor shaft 212 as shown in FIGS. 2-4 using nuts 220 and 222.

As is known, guy anchors must withstand high tensile forces from guy wires, which can reach tens of kilo-Newtons. Most arrangements of screws, nuts, and couplers cannot withstand those forces. The process of machining threads into materials generally weakens the materials. There are other methods of forming threads, however. In particular, threads may be formed in a material by rolling in a continuous pattern of threads or thread-like deformations. These may be applied during the forging process of the material. The resulting threaded material is much stronger than the same material in which threads are machined.

Bars, couplers, and nuts having threads formed in this manner are commercially available from DYWIDAG-Systems International (DSI). The DYWIDAG THREADBAR® series includes threaded rods, couplers, and nuts, which may be used advantageously in the modular guy anchor 200.

In the preferred embodiment, the anchor shaft 212 is a DYWIDAG THREADBAR rod, and the coupler 512 is a DYWIDAG THREADBAR coupler. The jamb nuts 216, 220, and 222 are preferably DYWIDAG THREADBAR lock nuts.

DYWIDAG THREADBAR components are available in different sizes. We have found that #14 components (i.e., rods, nuts, and couplers) are suitable for most tower applications; however the size of the components may be varied as the target site requires. DYWIDAG THREADBAR rods are preferably cut to 4.57 m (15 ft.) lengths. They are preferably 75 KSI steel, or higher. The #14 rods typically have a cross-sectional area of 1452 $mm^2$ (2.25 $in^2$) and a yield strength of 751 kN (168.8 Kips). The rods are galvanized and then coated with a layer of Line-X Xtra. The coating preferably covers region 1216 but does not extend to regions 1212 and 1214 (see FIG. 12). Typically, region 1212 is 0.36 M (1 ft, 2 in.) long and region 1214 is 0.61 M (2 ft.) long.

The size of the anchor head 210 varies with the number of guy wires to which it must attach and the resultant tensile force to be borne. However, a typical anchor head is about 48 cm (1 ft., 7 in.) long and wide, and is about 1.9 cm (0.75 in.) thick.

The optimal size of the bearing plate 214 will also vary based on load. A typical size is approximately 20 cm (8 in.) square and about 1.3 cm (0.5 in.) thick.

The DYWIDAG THREADBAR #14 couplers are typically 198.6 mm long (7.82 in.) long, and the #14 lock nuts are typically 36.8 mm (1.45 in) long. Sizes may be varied based on site requirements. For example, #18 rods, couplers, and nuts may be used for heavier duty applications. The DWYIDAG lock nuts are preferably galvanized per ASTM A123.

The anchor plate 510, rigging plates 610, and bearing plate 214 are preferably grade A572, 50 KSI steel. The completed anchor head weldment, including the anchor plate 510, coupler 512 and rigging plates 610, are preferably hot-dipped galvanized per ASTM A123 after fabrication.

Preferably, the anchor head 210 is available in a series of discrete sizes, such as small, medium, and large, to accommodate a wide range of site requirements. Similarly, the anchor shaft is preferably available in different stock lengths.

Figure 1:
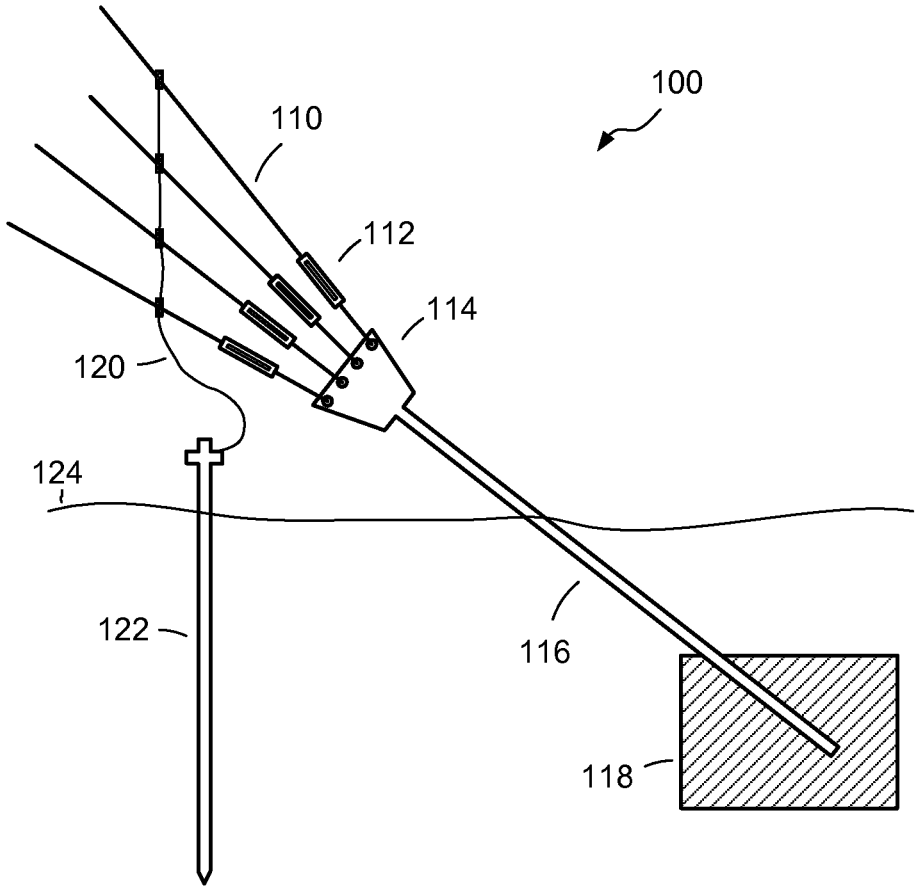
FIG. 1 is an elevation view of a conventional guy anchor for supporting a tower according to the prior art.

The guy anchor 200 can be used in a similar manner to the conventional guy anchor of FIG. 1. Guy anchors 200 may be installed around a tower mast, preferably at 120-degree spacing, and attached to the tower mast using guy wires. Each guy anchor may be installed in the conventional manner. A hole is excavated for each guy anchor, the guy anchor is placed in the hole oriented toward the tower, at an angle that substantially aligns with the expected resultant force from the guy wires. The hole is generally rectangular, with one side facing the tower mast. The anchors are each set in a concrete dead-man, and the holes are filled with earth. Once the concrete sets, the anchors may be rigged to the tower mast and the tower can be erected.

The installation process for the guy anchor 200 differs from the conventional process, however, because the guy anchor 200 may be assembled on-site. To assemble the guy anchor 200, an installer typically first checks the length of the anchor shaft 212. Many times, planned length and ultimate installed length of an anchor shaft may differ once details of soil composition, rockiness, and other factors are more fully known. If the anchor shaft 212 is too long, it may be cut on site by the installer to the preferred length. The cut is preferably made at the distal end of the shaft 212. Any field-cut edges are preferably galvanized with two coats of zinc rich galvanizing compound.

Once the shaft is the correct length, the installer attaches the anchor head 210 and bearing plate 214 to the shaft 212. The order of attachment is not important, although it is generally easier to install the bearing plate first.

The bearing plate is attached by spinning the jamb nut 220 onto the distal end of the shaft and advancing it approximately 15 cm (6 in.). The plate 214 is then applied, with the shaft 212 passed through the hole 1410, and the jamb nut 222 is applied over the end of the shaft 212. The nuts 220 and 222 are tightened together with the bearing plate 214 held fast between them.

Next, the installer attaches the anchor head 210 to the proximal end of the shaft 212. The installer inserts the jamb nut 216 over the end of the shaft, spins it down approximately 30 cm, and then threads the coupler 512 of the anchor head onto the shaft 212. The installer generally spins the anchor head down until the shaft 212 butts against the end 912 of the channel 910. The installer typically adjusts the location of the nut 216 and may unscrew the anchor head 210 to achieve the desired height and orientation of the anchor head. The nut 216 is then tightened to the coupler 512 to firmly fasten the anchor head 210 to the anchor shaft 212.

The modular guy anchor 200 is typically easier to install than the conventional, integral unit. As indicated, installations do not always go as planned. The ability to cut the anchor shaft 212 on-site thus provides the installer with an option not generally available with conventional designs. It may not even be necessary to cut the anchor shaft. Since the guy anchor 210 is modular, little extra cost is involved in transporting extra anchor shafts 212 to the installation site. A shaft that is too long can simply be swapped out for a smaller one, without costly delays. The modular components are generally easy to carry in the installer's truck. The anchor heads 210 can be stacked and the shafts 212 can be laid flat on the truck bed. In contrast, conventional integral guy anchors, which include both the head and the shaft, are bulky and typically longer than their modular counterparts.

For the same reasons, the modular guy anchor 200 can reduce shipping costs. Longer, bulkier items are more costly to ship than smaller, more compact ones. Also, since the modular design of the guy anchor 210 helps make it easier to have all the parts on hand that are needed to complete an installation, shipping costs are avoided that would otherwise be incurred from returning and replacing materials.

The modular guy anchor 200 is also simpler to stock. For example, if the anchor head 210 and anchor shaft 212 are each offered in three different sizes, then a warehouse need only stock three types of anchor heads and three types of shafts—a total of six parts. To get the same range of sizes with the conventional design, a warehouse would have to stock nine different types of parts. The more standard sizes there are, the greater the advantage of modularity. Also, with the conventional, integral design, each guy anchor is used relatively seldomly. Therefore, warehouses need to stock a lot of infrequently used parts if they are to be available quickly. This increases inventory and costs. The alternative would be to stock few parts and have guy anchors made to order. However, this option introduces long delays. These delays can be especially troublesome if an installation has already started, the guy anchor the installers initially planned to use does not fit, and the installers have to wait for a new one to be manufactured.

The use of corrosion-resistant materials, such as Line-X Xtra, provides a promising option for extending the useful life of guy anchor shafts. By preventing corrosion, costly repairs can be avoided. Tower safety is expected to improve, with reduced risk to human life and property.

Having described one embodiment, numerous alternative embodiments or variations can be made. For example, in the preferred embodiment, DWYIDAG THREADBAR components are used for the shaft 212, coupler 512, and jamb nuts 216, 220, and 222. However, this is not required. Other components may be used, such as those of Williams Form Engineering Corp. of Belmont, Mich. Although parts with threads formed with a rolled in pattern during forging are preferred because they tend to be stronger, they are not strictly required. In fact, any threaded rods, couplers, and nuts may be used, provided they meet the strength requirements.

As shown and described, a jamb nut 216 is used to attach the anchor head 210 to the anchor shaft 212. Alternatively, this nut may be eliminated as long as other provisions are made to prevent the anchor head 210 from rotating on the anchor shaft.

It is not strictly necessary that the tubular region 512 of the anchor head 210 have internal threads. The anchor shaft 212 may alternatively be held in place with pins or other modes of attachment.

According to one variant, the head plate 510 includes a central open region continuous with the channel 910. This open region is large enough so that the anchor shaft 212 may be inserted completely through the tubular region 512 and made to extend into the open region. A nut can be applied to the end of the anchor shaft within the open region. This nut may be used in place of or in addition to the nut 216. The tubular region 512 may be threaded or unthreaded in this scenario.

As shown and described, the anchor shaft 212 is threaded over its entire length. However, this is merely an example. Alternatively, the anchor shaft 212 may be threaded only at its proximal end and its distal end, for attaching the anchor head 210 and bearing plate 214, respectively. Indeed, the anchor shaft need not be threaded at all, provided other modes of attachment are provided to the anchor head and bearing plate.

As shown and described, a coating of Line-X Xtra is used as the corrosion-resistant material over the anchor shaft 212. However, other materials may be used, including other coatings incorporating a combination of urethane and DuPont Kevlar. In addition, other materials besides urethane can be combined with Kevlar to provide acceptable results. These include epoxy and latex, for example.

As shown and described, the coupler 512 is welded to the head plate 510/1612 and the rigging plates 610 are welded to the coupler 512. Alternatively, all three components, or any two of the three, may be formed integrally.

Those skilled in the art will therefore understand that various changes in form and detail may be made to the embodiments disclosed herein without departing from the scope of the invention.

REFERENCES USED IN THE FIGURES

| Reference Numeral | Description |
|---|---|
| 100 | Guy Anchor |
| 110 | Guy Wire(s) |
| 112 | Turnbuckle(s) |
| 114 | Guy Anchor Head |
| 116 | Guy Anchor Shaft |
| 118 | Dead-Man |
| 120 | Electrically Conductive Cable |
| 122 | Ground Spike (Copper) |
| 124 | Ground or Grade Level |
| 200 | Modular Guy Anchor |
| 210 | Anchor Head |
| 212 | Threaded Bar |
| 214 | Anchor Bearing Plate |
| 216, 220, 222 | Nuts |
| 510 | Anchor Head Plate |
| 512 | Coupler |
| 516 | Holes for Guy Wires |
| 518 | Center Axis of Anchor Head Plate |
| 610 | Rigging Plate |
| 710 | Hole in Rigging Plates |
| 910 | Channel in Anchor Head Plate |
| 912 | End of channel 910 |
| 1210 | Threads of Threaded Bar |
| 1212 | Proximal Region without Corrosion-Resistant Material |
| 1214 | Distal Region without Corrosion-Resistant Material |
| 1216 | Region with Corrosion-Resistant Material |
| 1310 | Internal Threads of Nut |
| 1410 | Hole in Bearing Plate |

What is claimed is:

1. A modular guy anchor, comprising:

an anchor head plate having a plurality of holes for attaching to multiple guy wires;

a coupler fixedly attached to the anchor head plate; and an anchor shaft having one end extending into or through the coupler and retained therein, wherein the anchor head plate has a channel formed therein, and wherein the coupler is disposed within the channel and welded to the anchor head plate.

2. The modular guy anchor of claim 1, wherein the anchor head plate has an open region continuous with the channel, wherein the end of the anchor shaft extends through the coupler into the open region, wherein the jamb nut is applied to the anchor shaft outside the open region, and wherein the modular guy anchor further comprises a second jamb nut applied to the anchor shaft abutting the coupler within the open region.

3. The modular guy anchor as recited in claim 1, wherein the anchor shaft comprises galvanized steel and a coating of corrosion-resistant material over the galvanized steel along at least a portion of the length of the anchor shaft.

4. The modular guy anchor as recited in claim 3, wherein the corrosion-resistant material comprises Kevlar and at least one of urethane, epoxy, and latex.

5. The modular guy anchor as recited in claim 4, wherein the end of the anchor shaft is threaded, the coupler is internally threaded, and the anchor shaft and the coupler are threaded together.

6. The modular guy anchor as recited in claim 5, wherein the anchor shaft has a continuous, exterior, rolled-in pattern of thread-like deformations, and wherein the coupler has a continuous, interior, rolled-in pattern of thread-like deformations.

7. The modular guy anchor as recited in claim 6, further comprising a jamb nut applied to the anchor shaft abutting the coupler, wherein the jamb nut has a continuous, interior, rolled-in pattern of thread-like deformations.

8. A modular guy anchor comprising:

an anchor head plate;

an internally threaded coupler fixedly attached to the anchor head plate;

an anchor shaft having an end that is externally threaded, wherein the end of the anchor shaft and the coupler are threaded together; and a jamb nut threaded to the anchor shaft and abutting the coupler, wherein the coupler has a continuous, interior, rolled-in pattern of thread-like deformations, wherein the end of the anchor shaft has a continuous, exterior, rolled-in pattern of thread-like deformations, wherein the anchor head plate has a channel formed therein, and wherein the coupler is disposed within the channel and welded to the anchor head plate.

9. The modular guy anchor as recited in claim 8, wherein the jamb nut has a continuous, interior, rolled-in pattern of thread-like deformations.

10. The modular guy anchor of claim 8, wherein the anchor head plate has an open region continuous with the channel, wherein the end of the anchor shaft extends through the coupler into the open region, wherein the jamb nut is applied to the anchor shaft outside the open region, and wherein the modular guy anchor further comprises a second jamb nut applied to the anchor shaft abutting the coupler within the open region.

11. The modular guy anchor as recited in claim 8, wherein the anchor shaft is galvanized and has a coating of corrosion-resistant material including Kevlar and at least one of urethane, epoxy, and latex along at least a portion of its length.

12. A guy anchor comprising:

an anchor head plate;

a coupler fixedly attached to the anchor head plate; and an anchor shaft attached to the coupler, wherein the anchor shaft is galvanized and coated over at least a portion of its length with a material including a combination of Kevlar and at least one of urethane, epoxy, and latex, wherein the anchor head plate has a channel formed therein, and wherein the coupler is disposed within the channel of the anchor head plate.

13. A guy anchor comprising:

an anchor head plate;

a coupler fixedly attached to the anchor head plate; and an anchor shaft attached to the coupler, wherein the anchor shaft is galvanized and coated over at least a portion of its length with a material including a combination of Kevlar and at least one of urethane, epoxy, and latex, wherein the anchor head plate includes a central open region into which the anchor shaft extends.

14. The guy anchor of claim 13, further comprising a jamb nut applied to the anchor shaft within the open region.

* * * * *

UNITED STATES PATENT AND TRADEMARK OFFICE

CERTIFICATE OF CORRECTION

PATENT NO. : 8,578,665 B2
APPLICATION NO. : 13/758391
DATED : November 12, 2013
INVENTOR(S) : Jaime Reyes, Hanming You and Hernando Artista It is certified that error appears in the above-identified patent and that said Letters Patent is hereby corrected as shown below:

Title page 2, col. 1, line 7, listed under (56) References Cited, Other Publications reading:

"DYWIDAG Threadbar Reinforcing Systems," (Information Sheet) DYWIDAG Systems International USA, Inc.,
320 Marmon Drive, Bolingbrook, IL 60440, downloaded Oct. 26, 2010 from
http://www.dywidag-systems.com/uploads/media/DSA-USA_DYWIDAG_Threadbar_Reinforcing_Systems_us.pdf."
should read
--DYWIDAG Threadbar Reinforcing Systems," (Information Sheet) DYWIDAG Systems International USA, Inc.,
320 Marmon Drive, Bolingbrook, IL 60440, downloaded Oct. 26, 2010 from
http://www.dywidag-systems.com/uploads/media/DSI-USA_DYWIDAG_Threadbar_Reinforcing_Systems_us.pdf.--

In the Specification

Column 1, line 6, listed under the heading Cross-References to Related Applications reading:

"This is a continuation application of US Application No. 12/899,878, filed on October 7, 20120, which claims the benefit of US Provisional Application No. 61/363,646, filed July 13, 2010, which are incorporated herein by reference in their entireties."
should read
--This is a continuation application of US Application No. 12/899,878, filed on October 7, 2010, which claims the benefit of US Provisional Application No. 61/363,646, filed July 13, 2010, which are incorporated herein by reference in their entireties.--

Signed and Sealed this
Twenty-seventh Day of May, 2014

Michelle K. Lee

Michelle K. Lee
*Deputy Director of the United States Patent and Trademark Office*